US005391094A

United States Patent [19]

Kakinoki et al.

[11] Patent Number: 5,391,094

[45] Date of Patent: Feb. 21, 1995

[54] CARD-TYPE LINE INTERFACE DEVICE

[75] Inventors: Wataru Kakinoki, Yokohama; Masanobu Okada; Yasumasa Ueda, both of Sagamihara, all of Japan

[73] Assignee: Murata Mfg. Co., Ltd., Kyoto, Japan

[21] Appl. No.: 152,602

[22] Filed: Nov. 12, 1993

[30] Foreign Application Priority Data

Nov. 20, 1992 [JP] Japan ..... 4-310726

[51] Int. Cl.[6] ..... H01R 33/90; H01R 29/00

[52] U.S. Cl. ..... 439/638

[58] Field of Search ..... 439/638, 650, 651, 620

[56] References Cited

U.S. PATENT DOCUMENTS

| | | | |
|---|---|---|---|
| 3,141,721 | 7/1964 | Horn | 439/638 |
| 4,498,716 | 2/1985 | Ward | 439/650 |
| 4,523,296 | 6/1985 | Healy, Jr. | 439/651 |
| 4,611,875 | 9/1986 | Clarke et al. | 439/638 |
| 5,132,871 | 7/1992 | Densham et al. | 439/76 |
| 5,192,226 | 3/1993 | Wang | 439/650 |
| 5,276,443 | 1/1994 | Gate et al. | 439/620 |

FOREIGN PATENT DOCUMENTS

| | | | |
|---|---|---|---|
| 0288176 | 11/1990 | Japan | 439/638 |

*Primary Examiner*—Kurt Rowan
*Assistant Examiner*—Chuck Y. Mah
*Attorney, Agent, or Firm*—Jordan and Hamburg

[57] ABSTRACT

A card-type line interface device is provided with good portability and low-price. The line interface device includes an adapter unit 1 and a card unit 2 for inserting into the card slot of a communication terminal device. The adapter unit 1 has a card connecting connector 11 on a part of the boxlike body, a line connector 12 on another part thereof, and an interface circuit 14. The adapter unit 1 is connected to the card unit 2 in use, and detached from it on carrying. With no troublesome cable, the line interface device can provide good portability. The reduced number of components and reduced number of assembling steps lead to low price.

11 Claims, 3 Drawing Sheets

CARD-TYPE LINE INTERFACE DEVICE

BACKGROUND OF THE INVENTION

1. Field of the Invention

The present invention relates to a card-type interface device with improved portability.

2. Description of the Prior Art

FIG. 5 is a perspective view showing an embodiment of a conventional card-type line interface device. In FIG. 5, the card-type line interface device 500 includes a card unit 60. The card unit 60 is a cardlike body. A terminal connector 62 for connecting to a communication terminal device (T in FIG. 2) is arranged at one end of the cardlike body while a cable connecting connector 61 is arranged at the other end thereof.

A network control unit (NCU) 50 is formed separately from the card unit 60. The NCU 50 includes a card connector assembly 55, an NCU assembly 57, and a cable 56. The card connector assembly 55 has a card connecting connector 51 to connect to the cable connecting connector 61 of the card unit 60. The NCU assembly 57 has a line connector 52 and an NCU circuit 54 to connect to a communication line (K in FIG. 2). The cable 56 connects the NCU assembly 57 to the card connector assembly 55.

On communications, the card unit 60 is inserted into the card slot (S in FIG. 2) of the communication terminal unit (T in FIG. 2). The card connecting connector 51 of the NCU unit 50 is connected to the cable connecting connector 61, while the line connector 52 of the NCU unit 50 is connected to the communication line (K in FIG. 2).

The communication terminal device (T in FIG. 2) is carried with the card unit 60 inserted into the card slot (S in FIG. 2) thereof while the NCU unit 50 is disconnected from the communication terminal device to carry separately from it.

However the conventional card-type line interface device 500 has a disadvantage in that the cable 56 is troublesome in handling even-if the cable is folded for carriage. There is a further disadvantage in that extra components are needed including a cable clamp used to improve the internal mechanical strength of the connector assembly 55. Furthermore the number of assembling steps is disadvantageously increased to connect the NCU assembly 57 to the card connector assembly 55 using the cable 56.

SUMMARY OF THE INVENTION

In order to overcome the above mentioned problems, an object of the present invention is to provide an improved card-type line interface device that can provide good portability, reduced number of components, and reduced number of assembling steps.

According to the present invention, the card-type line interface device is structurally characterized by a card unit which is inserted into a card slot of a communication terminal device, the card unit having one end having a terminal connector arranged to a cardlike body thereof and connected with the communication terminal device and the other end having an adapter connecting connector; and an adapter unit arranged separately from the card unit, the adapter unit having a card connecting connector arranged on a part of a boxlike body for connecting with the adapter connecting connector, a line connector arranged on another part of the boxlike body for connecting with a communication line, and an interface circuit arranged internally between the card connecting connector and the line connector.

In the card-type line interface device according to the present invention, the adapter in a box shape includes a part having a card connecting connector for connecting the adapter connecting connector and another part having a line connector for connecting a communication line. Hence this structure has no cable.

Thus no cable provides good portability without being disturbed by the cable. Since pulling the cable accidentally does not occur, an additional component such as a cable clamp is not needed. Moreover it is possible to reduce the number of assembling steps.

DESCRIPTION OF THE PREFERRED EMBODIMENTS

With reference to the attached drawings, a further explanation will be made on an embodiment of the present invention. However it is apparent that the present invention should not be limited to only the embodiment.

Figure 1:
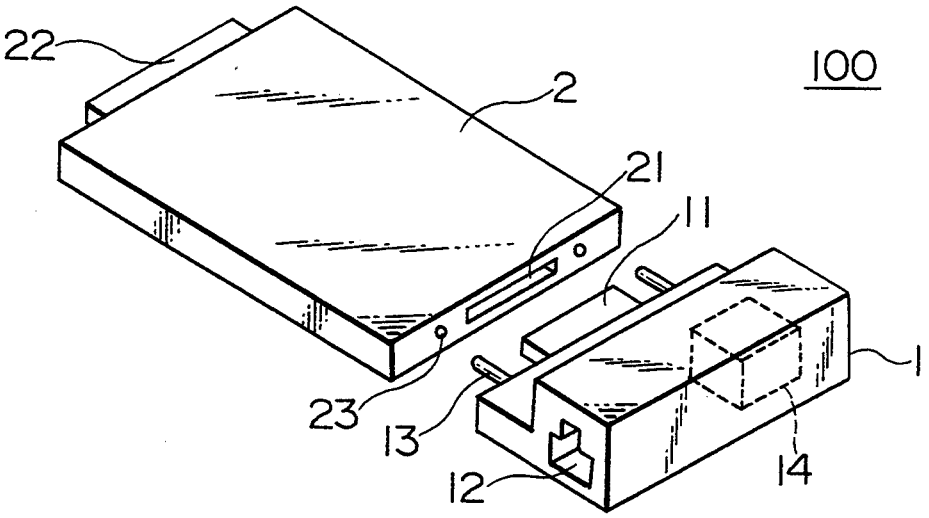
FIG. 1 is a perspective View of a card-type interface device according to an embodiment of the present invention.

FIG. 1 indicates a perspective view of an embodiment of the card-type line interface device according to the present invention.

The card-type line interface device 100 is constituted of a card unit 2 and an adapter unit 1. In the card unit 2, a terminal connector 22 is connected to a communication terminal device (T in FIG. 2) and arranged to the one end of the cardlike body. An adapter connecting connector 21 is arranged at the other end of the cardlike body. Pin holes 23 are formed on the sides spaced horizontally to the adapter connecting connector 21.

The adapter unit 1 is separated from the card unit 2. The card connecting connector 11 is disposed at a part of the boxlike body for connecting to the adapter connecting connector 21 of the card unit 2. The line connector 12 is used to connect the communication line (K in FIG. 2) and forms another part of the boxlike body. The NCU circuit is 14 arranged between the card connecting connector 11 and the line connector 12 and within the boxlike body. The adapter unit 1 also has stopper pins 13 for securely fixing the adapter unit 1 to the card unit 2 by inserting them into the pin holes 23 of the card unit 2.

Figure 2:
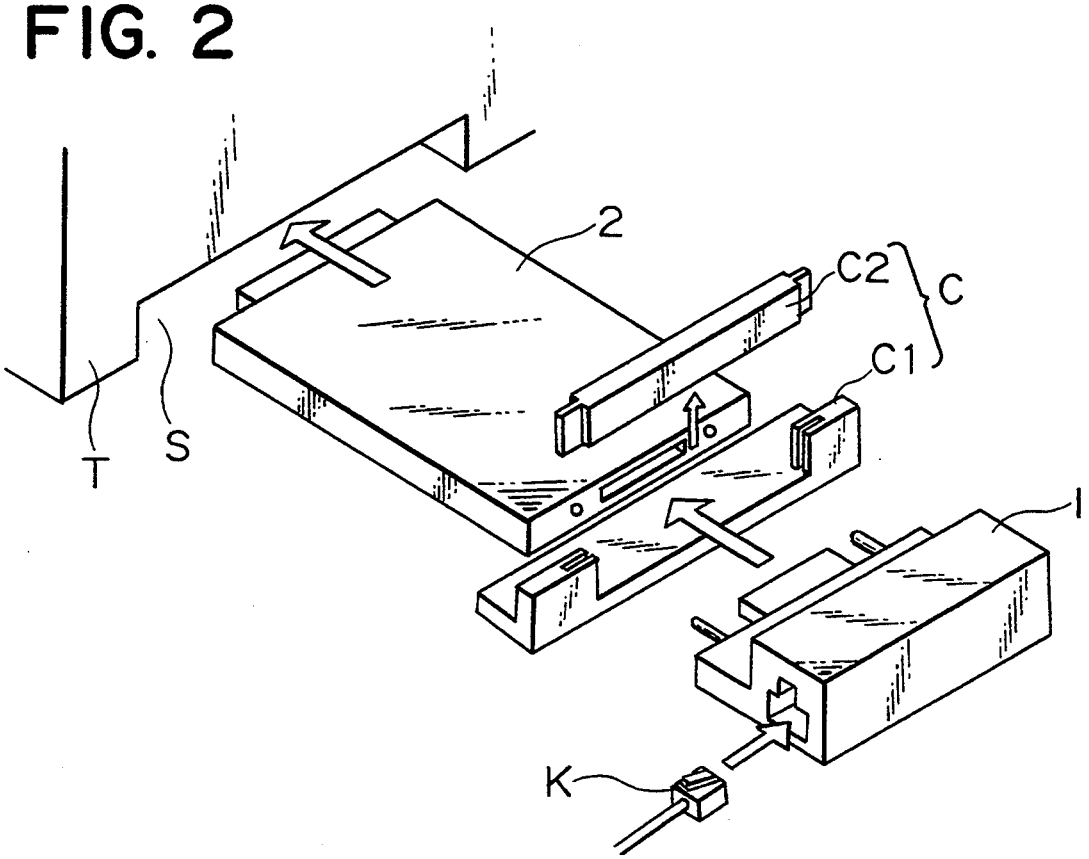
FIG. 2 is a diagram for explaining how the card-type line interface device shown in FIG. 1 is used.

FIG. 2 is an explanatory diagram showing the state in which the card-type line interface device 100 is used.

First, a separate-type cover C is removed out of the card slot S of the communication terminal device T. Then the card unit 2 is inserted into the card slot S. Next, in the separate-type cover C, only the window cover C2 is removed to remount the frame cover C1 to the communication terminal device T. Next, the card connecting connector 11 of the adapter unit 1 is inserted into the adapter connecting connector 21 of the card unit 2. At the same time, the stop pins 13 of the adapter unit 1 are inserted into the pin holes 23 of the card unit 2 to securely fix the adapter unit 1 to the card unit 2. Thereafter the communication line K is connected to the line connector 12 of the adapter unit 1.

When the communication terminal device T is carried, only the adapter unit 1 is removed while the card unit 2 is inserted into the card slot S of the communication terminal device T. Hence the adapter unit 1 is carried separately from the communication terminal device.

Figure 3:
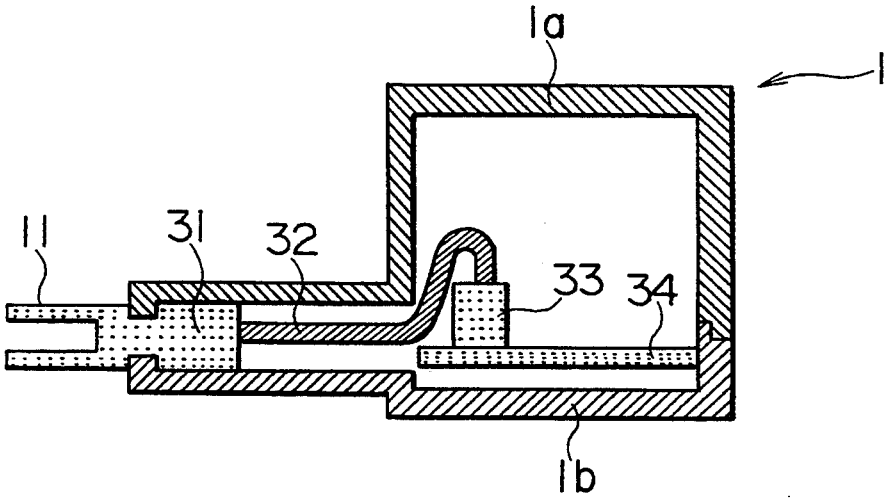
FIG. 3 is a cross-sectional view of the adapter unit of the card-type line interface device shown in FIG. 1.

FIG. 3 is a cross-sectional view of the adapter unit 1. Numeral la represents an upper cover for the boxlike body and 1*b* represents a lower cover for the same. The circuit substrate 34 mounts the NCU circuit 14 and a power source circuit. The circuit substrate 34 is connected to the card connecting connector 11 by way of the socket 33 of the circuit substrate 34, the electrical wire 32, and the lead 31 of the card connecting connector 11.

Figure 4:
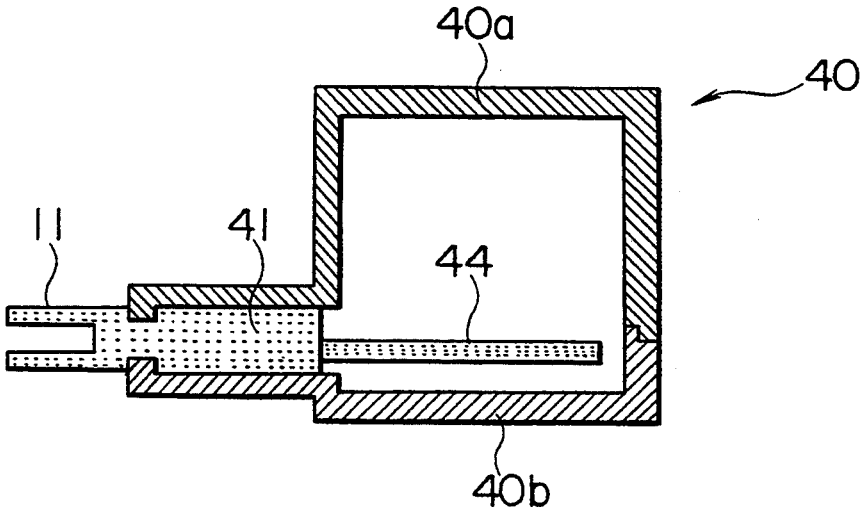
FIG. 4 is a cross-sectional view of the adapter unit according to another example of the present invention.
Figure 5:
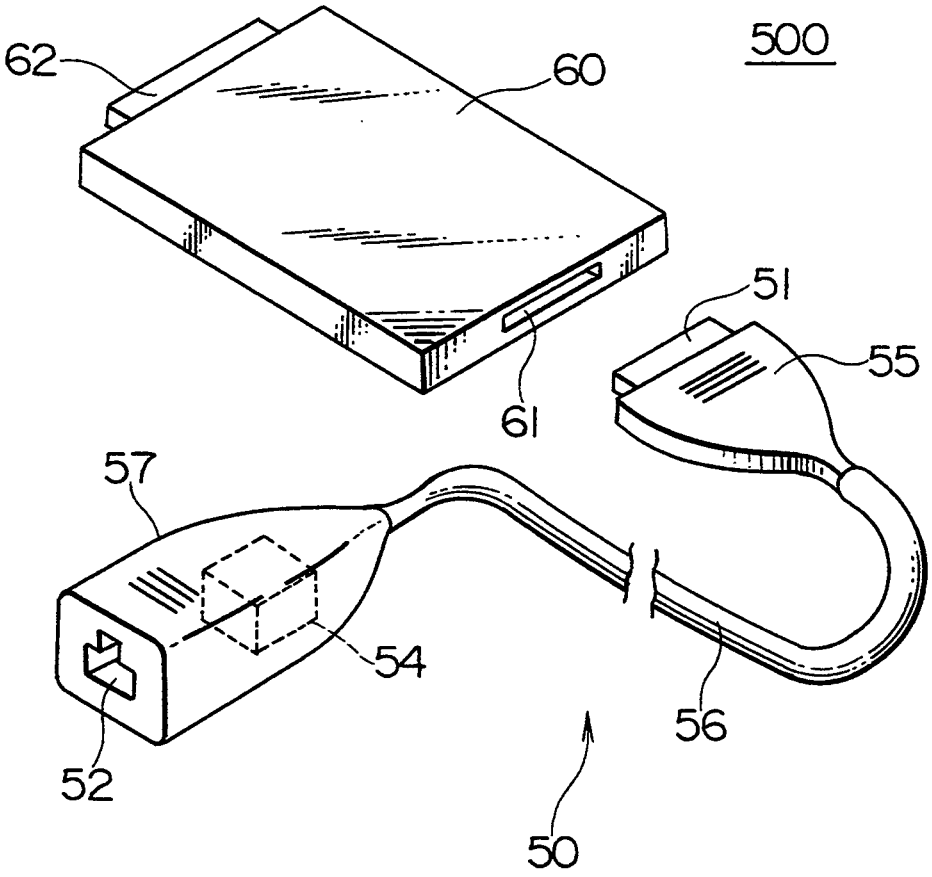
FIG. 5 PRIOR ART
FIG. 5 is a perspective view showing an example of a conventional card-type line interface device.

FIG. 4 represents a cross-sectional view of the adapter unit 40 according to another embodiment of the present invention. The adapter 40 includes an upper cover 40*a* for the boxlike body and a lower cover 40*b* for the boxlike body. Numeral 44 represents a circuit substrate mounting the NCU circuit 14 and the power source circuit. The circuit substrate 44 is directly soldered to the lead 41 of the card connecting connector 11 so as to connect the circuit substrate 44 to the card connecting connector 11.

Because of no cable in the NCU adapter unit 1, the card-type line interface device 100 improves its compactness and portability. This leads to reduced number of components, reduced number of assembling steps, and lowered manufacturing cost.

A modem has been represented in the above embodiment. However, the present invention can provide a card-type line interface device that similarly is effective to other communication lines such as local area networks (LANs) and integrated services digital networks (ISDNs).

According to the present invention, the card-type line interface device can be made so as to be small and light, thus providing good portability. The reduced number of components and assembling steps results in low manufacturing cost.

What is claimed is:

1. A card-type line interface device comprising:

a card unit which is inserted into a card slot of a communication terminal device, said card unit including:

a cardlike body, a terminal connector arranged at one end of said cardlike body and connected with said communication terminal device, and an adapter connecting connector arranged at another end of said cardlike body; and an adapter unit arranged separately from said card unit, said adapter unit including:

a boxlike body, a substantially inflexible card connecting connector arranged directly on a part of said boxlike body, without a flexible cable therebetween, for connecting with said adapter connecting connector, a line connector arranged on another part of said boxlike body for connecting with a communication line, and an interface circuit arranged internally of said boxlike body between said card connecting connector and said line connector for connecting said card connecting connector to said line connector.

2. A card-type line interface device according to claim 1, wherein said cardlike body includes at least one hole adjacent said adapter connecting connector thereof, and said adapter unit includes at least one pin means extending from said boxlike body adjacent said card connecting connector for engaging within said at least one hole.

3. A card-type line interface device according to claim 2, wherein there are two said holes and two said pins.

4. A card-type line interface device according to claim 1, wherein said interface circuit is directly connected to said card connecting connector.

5. A card-type line interface device according to claim 1, further including wire means entirely within said boxlike body for connecting said interface circuit to said card connecting connector.

6. A card-type line interface device comprising:

a card unit which is inserted into a card slot of a communication terminal device, said card unit including:

a cardlike body, a terminal connector arranged at one end of said cardlike body and connected with said communication terminal device, and an adapter connecting connector arranged at another end of said cardlike body; and an adapter unit arranged separately from said card unit, said adapter unit including:

a boxlike body, a substantially inflexible card connecting connector arranged directly on a part of said boxlike body, without a flexible cable therebetween, for connecting with said adapter connecting connector, a line connector arranged on another part of said boxlike body for connecting with a communication line, and an interface circuit arranged internally of said boxlike body between said card connecting connector and said line connector for connecting said card connecting connector to said line connector, said interface circuit being directly soldered to said card connecting connector.

7. A card-type line interface device according to claim 6, wherein said cardlike body includes at least one hole adjacent said adapter connecting connector thereof, and said adapter unit includes at least one pin means extending from said boxlike body adjacent said card connecting connector for engaging within said at least one hole.

8. A card-type line interface device according to claim 7, wherein there are two said holes and two said pins.

9. A card-type line interface device comprising:

a card unit which is inserted into a card slot of a communication terminal device, said card unit including:

a cardlike body, a terminal connector arranged at one end of said cardlike body and connected with said communication terminal device, and an adapter connecting connector arranged at another end of said cardlike body; and an adapter unit arranged separately from said card unit, said adapter unit including:

a boxlike body, a substantially inflexible card connecting connector arranged directly on a part of said boxlike body, without a flexible cable therebetween, for connecting with said adapter connecting connector, a line connector arranged on another part of said boxlike body for connecting with a communication line, an interface circuit arranged internally of said boxlike body between said card connecting connector and said line connector for connecting said card connecting connector to said line connector, and wire means entirely within said boxlike body for connecting said interface circuit to said card connecting connector, said wire means being soldered to said card connecting connector.

10. A card-type line interface device according to claim 9, wherein said cardlike body includes at least one hole adjacent said adapter connecting connector thereof, and said adapter unit includes at least one pin means extending from said boxlike body adjacent said card connecting connector for engaging within said at least one hole.

11. A card-type line interface device according to claim 10, wherein there are two said holes and two said pins.

* * * * *